US007510479B2

(12) United States Patent
Stengel

(10) Patent No.: US 7,510,479 B2
(45) Date of Patent: Mar. 31, 2009

(54) SANDBOX

(76) Inventor: Douglas L. Stengel, HC 37, Box 24, Valentine, NE (US) 69201

( * ) Notice: Subject to any disclaimer, the term of this patent is extended or adjusted under 35 U.S.C. 154(b) by 250 days.

(21) Appl. No.: 11/551,307

(22) Filed: Oct. 20, 2006

(65) Prior Publication Data

US 2008/0096679 A1 Apr. 24, 2008

(51) Int. Cl.
*A63G 31/00* (2006.01)

(52) U.S. Cl. ..... 472/126; 446/70; 108/25

(58) Field of Classification Search ..... 472/126; 446/70–77; 108/25–26
See application file for complete search history.

(56) References Cited

U.S. PATENT DOCUMENTS 1,018,373 A 2/1912 Robbins
1,338,034 A * 4/1920 Nickels ..... 4/549
4,427,391 A * 1/1984 Berman ..... 434/408
5,055,081 A * 10/1991 Nayak ..... 446/75
5,327,838 A 7/1994 Beltman
5,509,844 A * 4/1996 Poirier et al. ..... 446/71
5,640,911 A 6/1997 Peters
5,928,086 A * 7/1999 Strickland ..... 472/126
6,616,539 B1 * 9/2003 Gatto et al. ..... 472/126
6,662,732 B2 * 12/2003 Birsel et al. ..... 108/25

* cited by examiner

*Primary Examiner*—Kien Nguyen
(74) *Attorney, Agent, or Firm*—Dale J. Ream

(57) ABSTRACT

A sandbox according to the present invention includes a desk having a plurality of legs and defining an open receiving area. The sandbox includes a basin coupled to the desk and extending into the open receiving area, the basin having an area for receiving sand. The basin includes a plurality of sidewalls and at least one sidewall defines a notch. The desk includes a lip extending outwardly from the basin sidewall that defines a notch. The sandbox includes a perforated cover movable between a first configuration covering the lip and a second configuration exposing the lip, the cover defining a plurality of perforations to allow sand to pass through to the lip when at the first configuration. The sandbox includes a drawing board pivotally coupled to the lid and that may be maintained at various angles relative to an imaginary horizontal plane.

20 Claims, 6 Drawing Sheets

SANDBOX

BACKGROUND OF THE INVENTION

This invention relates generally to sandboxes and, more particularly, to a sand play station that may be used indoors, is portable, and may be used to hold other items.

Sand has always been a popular source of entertainment for young children. Both beaches and sandboxes enable kids to interact with one another or to play quite independently. In the past, sandboxes have typically been found outdoors, making playing in the sand difficult or even impossible on a rainy day or during the wintertime. Even on a clear or warm day, however, children must choose between playing outdoors in the sand or indoors with colors, markers, or other typically indoor activities.

Various devices have been proposed in the art for holding sand for play indoors. Although assumably effective for their intended purposes, the existing and proposed devices do not effectively maintain the sand within a basin, do not provide selective and convenient use of the sand, colors, markers, and the like, or are not effectively portable.

Therefore, it would be desirable have a sandbox that effectively maintains sand within a main basin and that provides for efficient cleanup of sand. Further, it would be desirable to have a sandbox that provides for selective play with sand or coloring or marking materials. In addition, it would be desirable to have a sandbox that is portable and movable.

SUMMARY OF THE INVENTION

Therefore, a sandbox according to the present invention includes a basin defining an interior area for receiving sand and having a floor with a plurality of sidewalls extending upwardly from the floor. At least one sidewall defines a notch. The sandbox includes a lip external to the basin and extending outwardly from the sidewall that defines a notch, the lip contacting the sidewall adjacent a lower surface of the notch.

The sandbox includes a perforated cover that is movable between first and second configurations, the cover extending from adjacent the upper edge of the lip to adjacent an upper edge of the sidewall that defines the notch when at the first configuration. The cover defines a plurality of perforations to allow sand to pass through the cover to the lip when the cover is at the first configuration. This allows sand to be efficiently collected for return to the basin.

The sandbox also includes a desk, the desk defining the lip and the basin being removably coupled to the desk. The desk includes a drawer and a removable pan is positioned in the drawer. A perforated grate is positionable upwardly adjacent the removable pan to allow sand to move from above the grate into the removable pan. This allows sand to be efficiently collected and removed from the drawer. A drawing board is pivotally coupled to the lid and it may be maintained at various angles relative to an imaginary horizontal plane.

Therefore, a general object of this invention is to provide a sandbox for holding sand in an indoor environment, that prevents sand from spilling, and that provides for efficient cleanup of sand.

Another object of this invention is to provide a sandbox, as aforesaid, that selectively provides for play with sand or a drawing board for use with colors or markers.

Still another object of this invention is to provide a sandbox, as aforesaid, in which the sandbox basin is removable.

Yet another object of this invention is to provide a sandbox, as aforesaid, that is portable and movable.

A further object of this invention is to provide a sandbox, as aforesaid, that includes a desk with drawers for holding items.

A still further object of this invention is to provide a sandbox, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

FIG. 5*b* is an isolated view on an enlarged scale taken from FIG. 5*a.

DESCRIPTION OF THE PREFERRED EMBODIMENT

Figure 1:
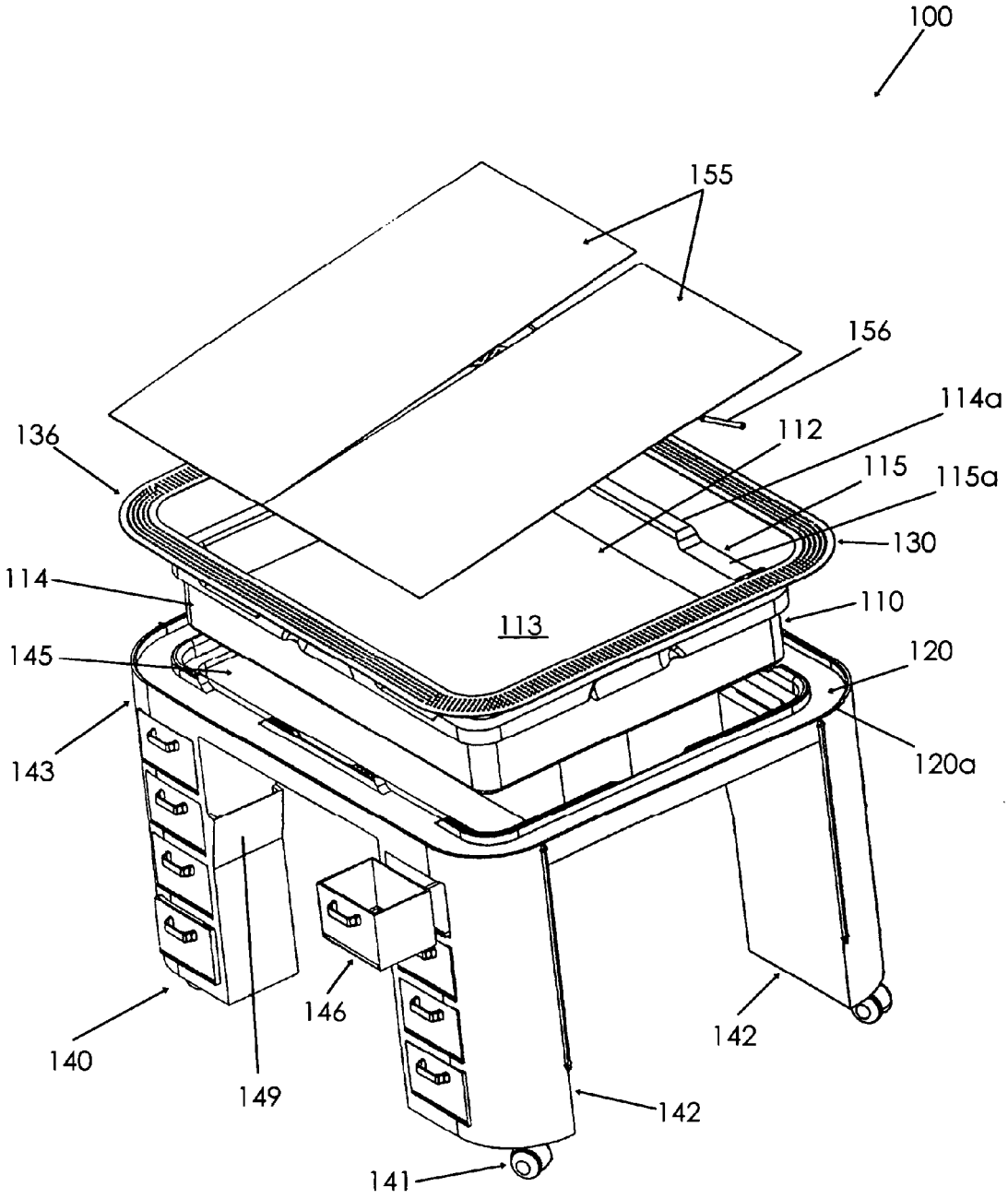
FIG. 1 is an exploded view of a sandbox according to a preferred embodiment of the present invention.

A sandbox 100 according to the present invention will now be described in detail with reference to FIGS. 1 through 6 of the accompanying drawings. More particularly, a sandbox 100 according to the current invention includes a basin 110.

The basin 110 defines an interior area 112 for receiving sand or another substance (e.g., water), and the basin 110 has a floor 113 and a plurality of sidewalls 114 extending upwardly from the floor 113. Each sidewall 114 has an upper edge 114*a,* and at least one of the sidewalls 114 defines a notch 115 that extends from a respective upper edge 114*a* toward the floor 113. Each notch 115 has a lower surface 115*a*.

Figure 2A:
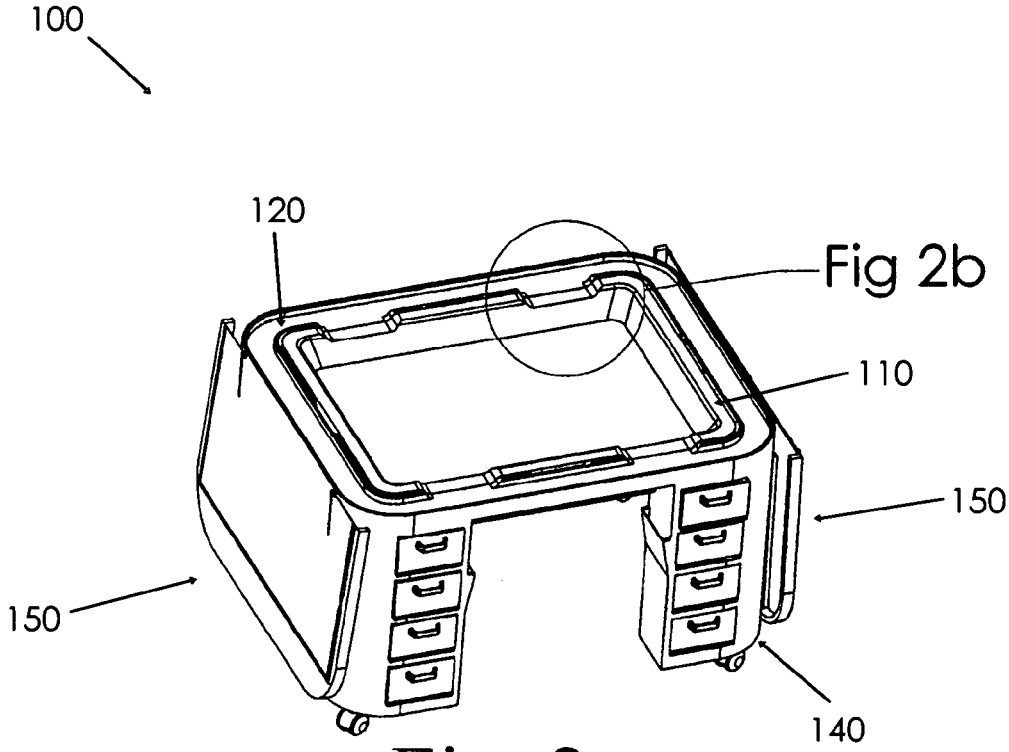
FIG. 2*a* is a perspective view of the sandbox as in FIG. 1.
Figure 2B:
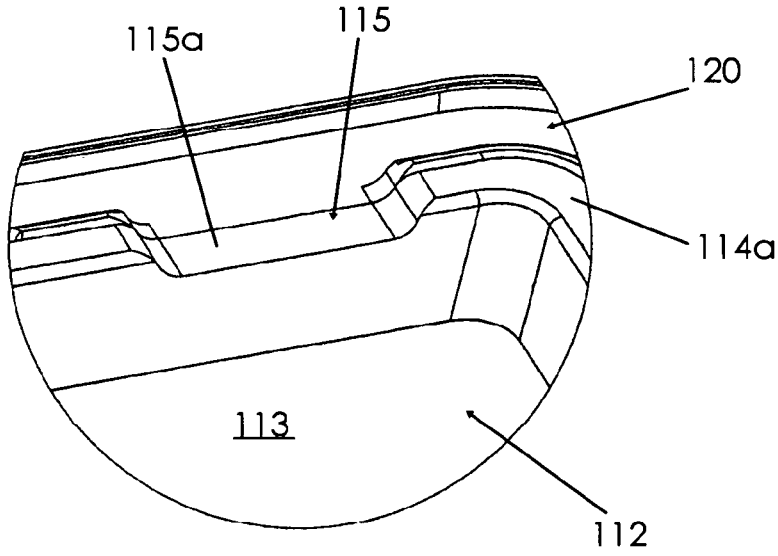
FIG. 2*b* is an isolated view on an enlarged scale of a portion of the sandbox taken from FIG. 2*a;*

As best shown in FIG. 2*b,* a lip 120 may be external to the basin 110 so that the lip 120 extends outwardly from the sidewalls 114 defining the notches 115. The lip 120 may contact the sidewalls 114 adjacent the lower surfaces 115*a* of the notches 115, and the lip 120 may have an upper edge 120*a* at a height vertically adjacent the sidewall upper edge 114*a* or at least at a height that is above the lower surfaces 115*a* of the notches 115.

Figure 6:
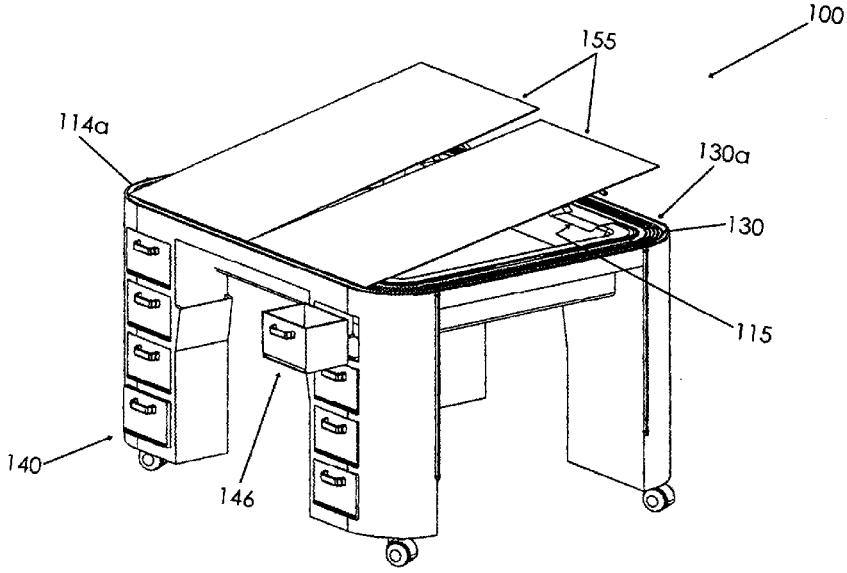
* and FIG. 6 is a perspective view of the desk as in FIG. 2*a* illustrating the drawing board in a selected configuration.

A perforated cover 130 may be movable between a first configuration 130*a* (FIG. 6) covering the lip 120 and a second configuration 130*b* (FIG. 1) exposing the lip 120. When at the first configuration 130*a,* the cover 130 may extend from adjacent the lip upper edge 120*a* to adjacent the upper edge 114*a* of the sidewall(s) 114 defining the notch(es) 115. As shown in FIGS. 1 and 6, the cover 130 may define a plurality of perforations to allow sand to pass through the cover 130 and to the lip 120 when the cover 130 is at the first configuration 130*a*. When at the second configuration 130*b* (FIG. 1), the cover 130 is distanced from the upper edge 114*a* of the sidewall(s) 114 defining the notch(es) 115 to allow sand to be moved from the lip 120 through the notch(es) 115 and into the basin interior area 112. In this manner, sand that may have accumulated in the lip 120 may be returned to the basin 110. The lip 120 and/or the cover 130 may extend around the basin 110 when the cover 130 is at the first configuration 130*a*.

As shown throughout the drawings, the sandbox 100 may include a desk 140. The desk 140 may define the lip 120, and the basin 110 may be coupled (either permanently or removably) to the desk 140. The desk 140 may have a plurality of legs 142 and a top side 143, and the desk 140 may define an open receiving area 145 accessible at the top side 143. The basin 110 may extend into the desk open receiving area 145 as shown in FIG. 1, for example. Though not shown, the plurality of legs 142 may be interconnected, to form a pedestal, for example.

Figure 3:
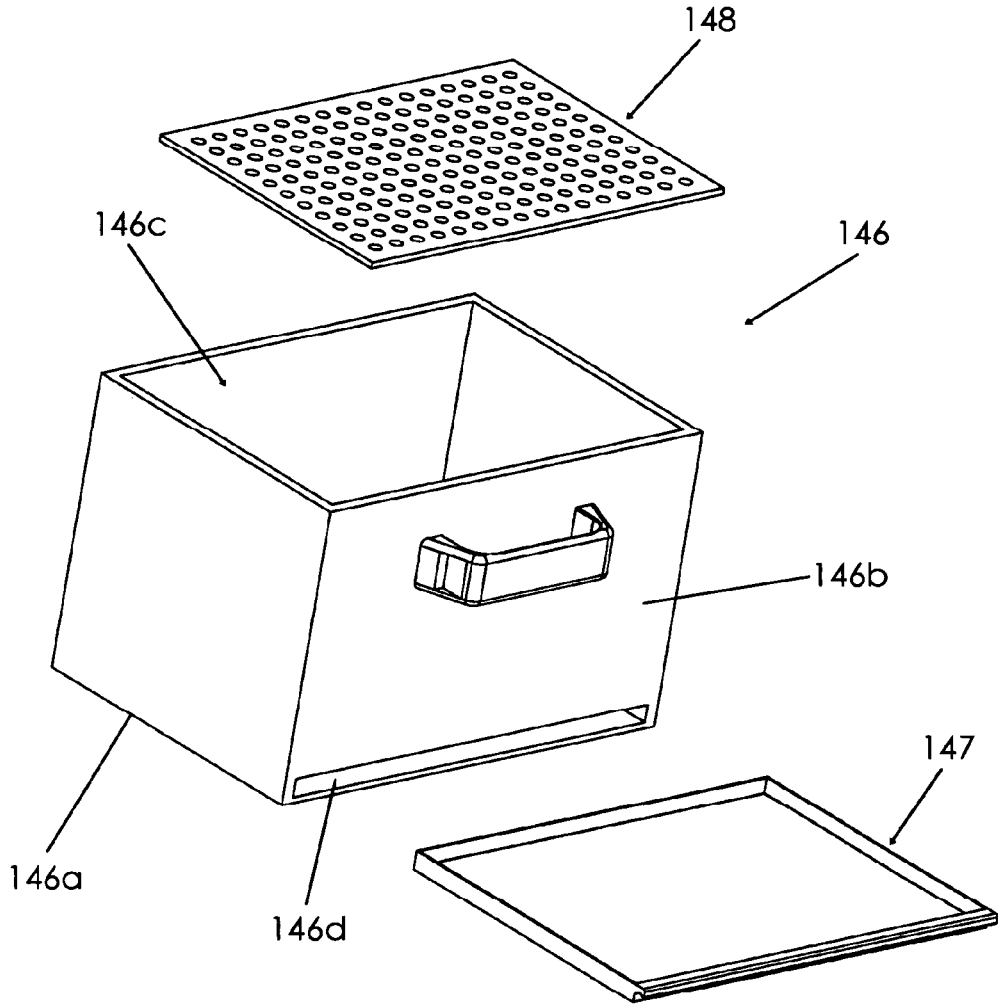
FIG. 3 is an isolated exploded view of a drawer taken from FIG. 1.
Figure 4A:
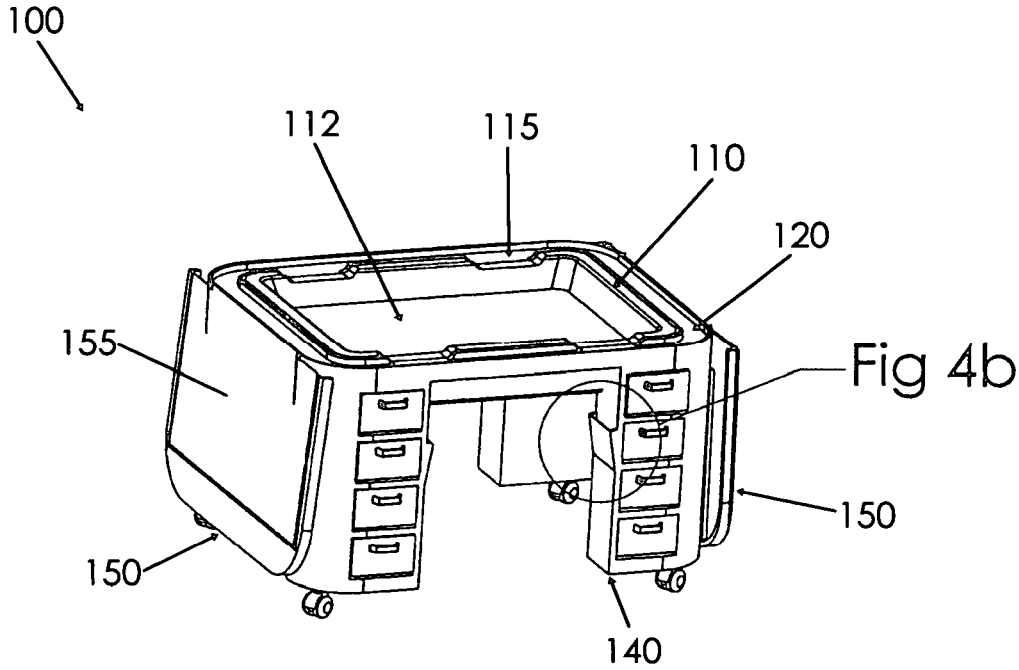
FIG. 4*a* is another perspective view of the sandbox as in FIG. 2*a;*
Figure 4B:
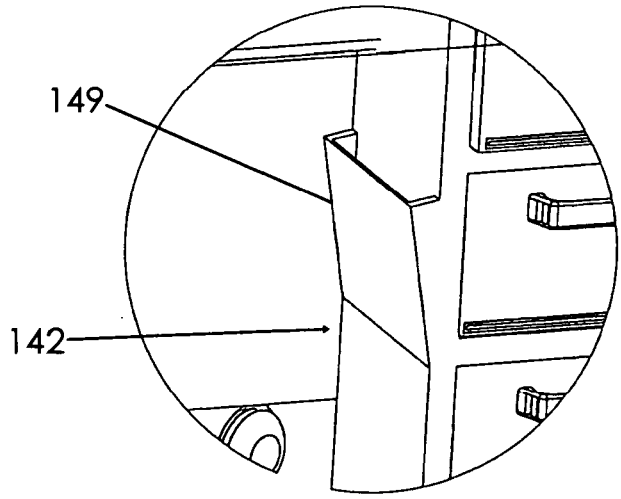
FIG. 4*b* is an isolated view on an enlarged scale taken from FIG. 4*a;*

The desk 140 may include a drawer 146 that has a bottom 146*a*, a plurality of sidewalls 146*b*, and defines an open area 146*c*, as shown in FIG. 3. Of course, the desk 140 may include a plurality of drawers, each having a substantially similar construction. A removable pan 147 may be positionable in the drawer open area 146*c* adjacent the drawer bottom 146*a*, and a removable perforated grate 148 may be positionable upwardly adjacent the removable pan 147 to allow sand to pass from above the grate 148 to the removable pan 147. A respective drawer sidewall 146*b* may define a slot 146*d* adjacent the drawer bottom 146*a* to allow the pan 147 to move between the drawer open area 146*c* and an area outside the drawer 146. The desk 140 may additionally or alternately include pocket 149 (FIG. 4*b*) coupled to a respective leg 142 and extending toward another respective leg 142, and/or a wheel(s) 141 (FIG. 1) may be coupled to the desk 140 for moving the desk 140.

Figure 5A:
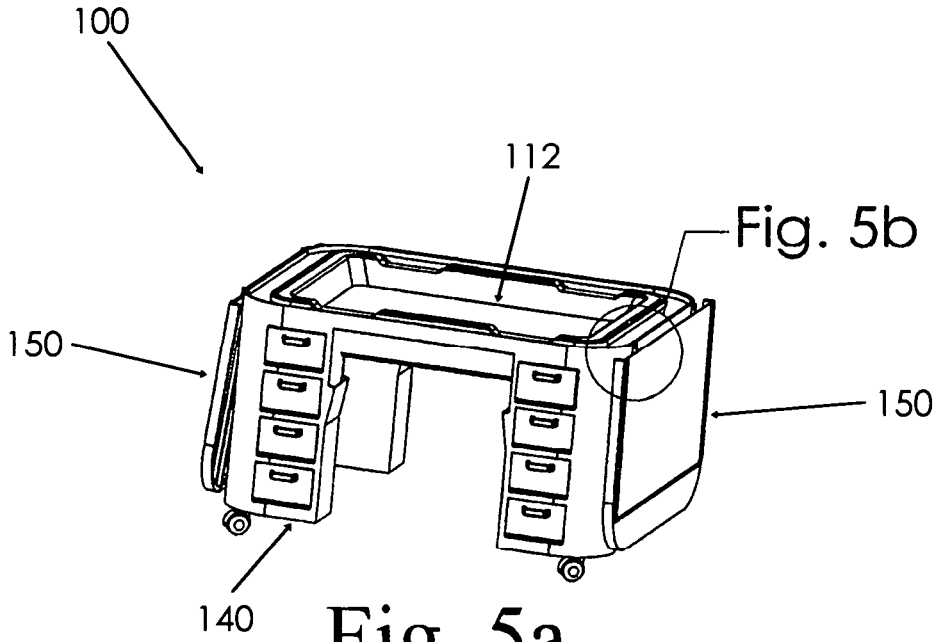
FIG. 5*a* is another perspective view as in FIG. 4*b* taken from another angle.
Figure 5B:
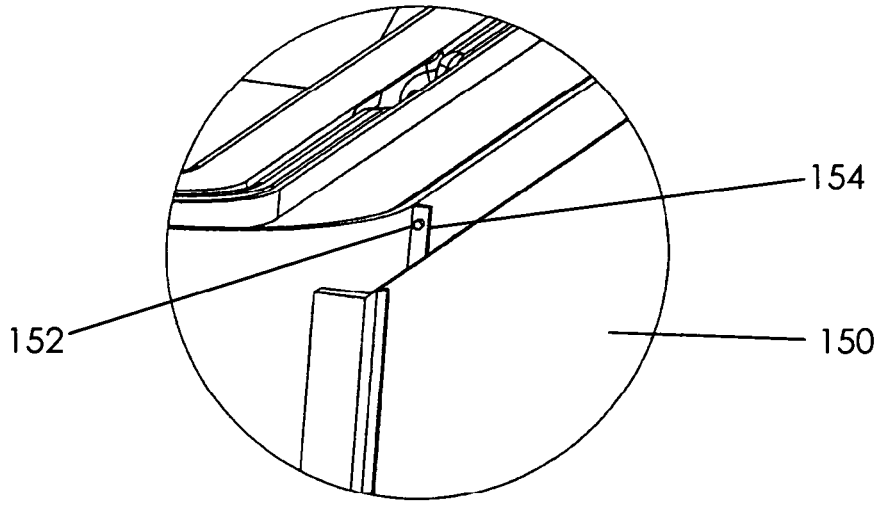

A lid 150 may be included for selectively restricting access to the basin interior area 112. The lid 150 may be pivotally and/or slidably coupled to the desk 140, such as through a pivoting member 152 and/or a sliding member 154 as shown in FIG. 5*b*. A drawing board 155 may be pivotally coupled to the lid 150 as shown in FIGS. 1, 2*a*, and 5*a* to provide a user with a flat surface for drawing or otherwise creating artwork. Means for maintaining the drawing board 155 at various angles relative to an imaginary horizontal plane may be included. More particularly, sliding or telescoping members 156 (FIG. 1) or other appropriate fasteners may be used to angle the drawing board 155.

In use, sand may be placed in the interior area 112 of the basin 110, and a child may reach into the basin 110 or otherwise play in the sand. Sand that is strewn outside the basin 110 may pass through the perforated cover 130 and onto the lip 120. A user may remove the cover 130 and sweep the sand through the notch(es) 115 and into the basin interior area 112 as desired. Toys or other implements may be held in the drawer 146 and/or the pocket 149. The removable pan 147 may be pulled through the drawer slot 146*d* or otherwise separated from the drawer open area 146*c* and emptied as desired. The desk 140 may be selectively moved using the wheel(s) 141. The lid 150 may selectively cover the basin interior area 112 (and therefore restrict access to any sand contained therein) as discussed above, and the drawing board 155 may be used as described above.

It is understood that while certain forms of this invention have been illustrated and described, it is not limited thereto except insofar as such limitations are included in the following claims and allowable functional equivalents thereof.

The invention claimed is:

1. A sandbox, comprising:

a basin defining an interior area for receiving sand, said basin having a floor and a plurality of sidewalls extending upwardly from said floor, said sidewalls having respective upper edges, at least one said sidewall defining a notch extending from a respective upper edge toward said floor and having a lower surface;

a lip external to said basin and extending outwardly from said at least one sidewall that defines said notch, said lip contacting said sidewall adjacent said notch lower surface, said lip having an upper edge at a height vertically adjacent said sidewall upper edge;

a perforated cover movable between first and second configurations, said cover extending from adjacent said lip upper edge to adjacent said upper edge of said at least one sidewall that defines said notch when at said first configuration, said cover defining a plurality of perforations to allow sand to pass through said cover to said lip when at said first configuration; and wherein said cover is distanced from said upper edge of said at least one sidewall that defines said notch to allow sand to be moved from said lip through said notch and into said basin interior area when at said second configuration.

2. The sandbox of claim 1, further comprising a desk, and wherein:

said desk defines said lip; and said basin is coupled to said desk.

3. The sandbox of claim 2, wherein said basin is removably coupled to said desk.

4. The sandbox of claim 2, wherein:

said desk includes a drawer having a bottom and defining an open area;

a removable pan is positionable in said drawer open area adjacent said drawer bottom; and a perforated grate is positionable upwardly adjacent said removable pan to allow sand to pass from above said grate to said removable pan.

5. The sandbox of claim 4, wherein:

said drawer includes a plurality of sidewalls; and at least one said drawer sidewall defines a slot adjacent said drawer bottom to allow said pan to move between said drawer open area and an area outside said drawer.

6. The sandbox of claim 2, further comprising a lid for selectively restricting access to said basin interior area.

7. The sandbox of claim 6, wherein said lid is at least one of slidably and pivotally coupled to said desk.

8. The sandbox of claim 7, further comprising:

a drawing board pivotally coupled to said lid; and means for maintaining said drawing board at various angles relative to an imaginary horizontal plane.

9. The sandbox of claim 8, wherein:

said basin is removably coupled to said desk;

said desk includes a drawer having a bottom and defining an open area;

a removable pan is positionable in said drawer open area adjacent said drawer bottom; and a perforated grate is positionable upwardly adjacent said removable pan to allow sand to pass from above said grate to said removable pan.

10. The sandbox of claim 2, further comprising a wheel coupled to said desk for selectively moving said desk, and wherein:

said desk includes a plurality of legs; and said desk includes a pocket coupled to a respective leg, said pocket extending toward another respective leg.

11. A sandbox, comprising:

a desk having a plurality of legs, a top side, and defining an open receiving area accessible at said top side;

a basin coupled to said desk and extending into said desk open receiving area, said basin defining an interior area for receiving sand, said basin having a floor and a plurality of sidewalls extending upwardly from said floor, said sidewalls having respective upper edges, a respective sidewall defining a notch extending from a respective upper edge toward said floor, said notch having a lower surface;

wherein said desk includes a lip extending outwardly from said basin sidewall defining said notch, said lip contacting said sidewall adjacent said notch lower surface, said lip having an upper edge at a height above said notch lower surface; and a perforated cover movable between a first configuration covering said lip and a second configuration exposing said lip, said cover defining a plurality of perforations to allow sand to pass through said cover to said lip when at said first configuration.

12. The sandbox of claim 11, wherein said basin is removably coupled to said desk.

13. The sandbox of claim 11, wherein:

said desk includes a drawer having a bottom and defining an open area;

a removable pan is positionable in said drawer open area adjacent said drawer bottom; and a perforated grate is positionable upwardly adjacent said removable pan to allow sand to pass from above said grate to said removable pan.

14. The sandbox of claim 13, wherein:

said drawer has a plurality of sidewalls; and at least one said drawer sidewall defines a slot adjacent said drawer bottom to allow said pan to move between said drawer open area and an area outside said drawer.

15. The sandbox of claim 11, further comprising a lid for selectively restricting access to said basin interior area.

16. The sandbox of claim 15, wherein said lid is at least one of slidably and pivotally coupled to said desk.

17. The sandbox of claim 15, further comprising:

a drawing board pivotally coupled to said lid; and means for maintaining said drawing board at various angles relative to an imaginary horizontal plane.

18. The sandbox of claim 17, wherein said lip extends around said basin and said perforated cover extends around said basin when at said first configuration.

19. The sandbox of claim 11, wherein said lip extends around said basin.

20. The sandbox of claim 19, wherein said perforated cover extends around said basin when at said first configuration.

* * * * *